US005927949A

United States Patent [19]

Ogasawara

[11] Patent Number: 5,927,949

[45] Date of Patent: Jul. 27, 1999

[54] PLASTIC FAN

[75] Inventor: Masayuki Ogasawara, Shizuoka-ken, Japan

[73] Assignee: Usui Kokusai Sangyo Kabushiki Kaisha, Ltd., Shizuoka-ken, Japan

[21] Appl. No.: 08/907,462

[22] Filed: Aug. 8, 1997

[30] Foreign Application Priority Data

Aug. 9, 1996 [JP] Japan ..... 8-226115

[51] Int. Cl.[6] ..... F04D 29/34

[52] U.S. Cl. ..... 416/229 R; 416/241 A; 416/244 R

[58] Field of Search ..... 416/204 R, 213 A, 416/229 R, 241 A, 244 R; 264/271.1, 274, 279

[56] References Cited

U.S. PATENT DOCUMENTS

| | | | |
|---|---|---|---|
| 3,318,388 | 5/1967 | Bihlmire | 416/229 R |
| 4,153,389 | 5/1979 | Boyd | 416/241 A |
| 5,226,807 | 7/1993 | By et al. | 416/244 R |
| 5,507,622 | 4/1996 | Avny | 416/229 R |
| 5,593,283 | 1/1997 | Scott | 416/244 R |
| 5,720,595 | 2/1998 | Avny | 416/241 A |

FOREIGN PATENT DOCUMENTS

| | | | |
|---|---|---|---|
| 1950139 | 4/1971 | Germany | 416/241 A |
| 2361481 | 6/1974 | Germany | 416/229 R |
| 4234292 | 4/1994 | Germany | 416/204 R |

*Primary Examiner*—Christopher Verdier
*Attorney, Agent, or Firm*—McDermott, Will & Emery

[57] ABSTRACT

A plastic fan is composed of a plastic-made fan portion and a metal-made insert portion integrally embedded in the plastic-made fan portion. The fan portion is formed of fan blades and a fan boss. The insert portion is formed of a ring-shaped flat base portion and a bent portion extending upright from an outer peripheral edge of the base portion and having a substantially ring-shaped configuration in plan and a flattened U-shaped configuration in cross-section. The insert portion defines lock holes arranged at predetermined intervals in an outer peripheral portion of the metal-made insert portion and extending through the metal-made insert portion from an outer side thereof to an inner side thereof. The inner peripheral edge portion of each of the lock holes is formed of a smooth flat surface on at least one of the outer side and the inner side of the metal-made insert portion.

3 Claims, 5 Drawing Sheets

PLASTIC FAN

FIELD OF THE INVENTION a) Field of the Invention

This invention relates to a cooling fan, which is made of plastic and, which is hereafter called a "plastic fan".

More specifically, this invention relates to a plastic composed of a plastic fan portion and a metal-made insert portion integrally embedded in the plastic fan portion.

In particular, this invention relates to a plastic fan having improved durability owing to prevention of fan damage which would otherwise be caused by a metal-made insert portion integrally embedded in a plastic-made fan portion.

b) Description of the Related Art

A plastic fan is useful as a cooling fan superior to conventional metal-made fans in many aspects such as low noise production, light weight, high cooling performance, and designing convenience (designing flexibility).

Plastic fans are therefore widely used in a wide variety of industrial fields such as automotive vehicles, construction machinery, agricultural machinery, and railway vehicles.

A plastic fan of this type is generally composed of a plastic(synthetic resin) fan portion, which is formed of plastic(synthetic resin) fan blades and a fan boss as a base for the fan blades. A metal insert portion integrally embedded in the plastic fan portion and has a substantially ring-shaped configuration in plan and a flattened U-shaped configuration in cross-section.

The construction of a plastic fan of this type is illustrated in FIGS. 1 and 2 which will also be referred to subsequently herein for the description of the present invention.

In FIGS. 1 and 2, the plastic fan F is composed of:

(i) a plastic fan portion formed of plastic fan blades and a plastic fan boss; and (ii) a metal insert portion integrally embedded in the fan boss of the plastic fan portion and having a substantially ring-shaped configuration in plan and a flattened U-shaped configuration in cross-section.

Incidentally, as is illustrated in FIG. 2, the metal insert portion is formed of a base portion and a bent portion. The bent portion is integrally embedded inside the plastic fan boss.

To ensure firm integral embedding of the metal insert portion inside the fan boss of the plastic fan portion, lock holes are generally formed in an outer peripheral portion of the metal insert portion so that the lock holes extend all the way through from an outer side to an inner side of the metal insert portion. The lock holes have the function of preventing separation of the metal insert from a synthetic resin inside the fan boss made of the synthetic resin and resulting rotation of the metal insert when the plastic fan is driven at a high speed.

One example of arrangement of the lock holes is shown in FIG. 3 which will also be referred to subsequently herein for the description of the present invention. In the drawing, the lock holes are indicated at reference symbol 2*a*.

A melt of the synthetic resin which makes up the fan boss uniformly flows to the outer side and inner side of the metal insert portion through the lock holes 2*a*, whereby both the members, that is, the plastic fan portion 1 and the metal insert portion 2 are firmly integrated.

However, the conventional plastic fan of the above-described construction has the following problems due to the structure of the metal insert portion.

The problems of the conventional plastic fan of the above-described construction will hereinafter be described with reference to FIGS. 5A through 9.

In the following description, elements of the conventional art in the drawings will be indicated by primed symbols in order to make a distinction between the present invention and the conventional art. Namely, elements of the present invention, which correspond to like elements in the conventional art, are described by using non-primed symbols.

For example, a plastic fan according to the present invention is indicated by F whereas the plastic fan according to the conventional art is identified by F'.

FIGS. 5A and 5B illustrate problems of the conventional plastic fan F' of the above-described construction.

When the plastic fan F' is driven at a high speed, for example, at 4,000 rpm, centrifugal force X of each fan blade 11' acts as a principal component of stress, and the stress is supported by a fan boss 12' (see FIG. 5A).

As the centrifugal stress X which acts as external force on the fan boss 12' increases, the synthetic resin portion undergoes increasing deformation relative to a metal-made insert 2' integrally embedded and fixed in the boss 12'. When the synthetic resin portion reaches a deformable maximum limit, cracks or the like are formed (see FIG. 5B).

The above-described matters will be described in further detail with reference to FIGS. 5A and 5B.

As the centrifugal stress X which acts as external force on the fan boss 12' increases, the synthetic resin portion on a side of an inner periphery of the fan boss 12' is pulled in the direction of the centrifugal stress X at positions corresponding to lock holes 2*a*' of the metal insert portion 2' so that recesses 2*c*' are formed as depicted in FIG. 5B.

Further, at positions where the lock holes 2*a*' do not exist, the synthetic resin portion on a side of an outer periphery of the fan boss 12' is also similarly pulled in the direction of the centrifugal stress X so that gaps 2*d*' are formed between the metal insert portion 2' and the synthetic resin portion.

As a consequence, concentration of stress takes place around each lock hole 2*a*' through the above-described deformation of the synthetic resin portion.

In the course of the above-described concentration of stress, existence of a small deformed portion around (i.e., at a peripheral edge portion of) each lock hole 2*a*' provides a growth point for breaking such as a growth point for a crack due to concentration of stress by large centrifugal force X under high-speed rotation, whereby the durability of the plastic fan F' is considerably lowered.

The above-described problems of the plastic fan F' of the conventional art are illustrated in FIGS. 6 through 9.

Incidentally, FIGS. 6 through 9 show problems observed when a plastic fan F' having a diameter of 430 mm and provided with eight blades was continuously driven at 100° C. and 4,000 rpm. The above conditions of 100° C. and 4,000 rpm are those for accelerated tests and in view of normal use conditions, can be considered to be a high-temperature atmosphere and a high rotation speed.

FIG. 6 illustrates portions 11*a*' 12*a*', where whitening was observed after the plastic fan F' was driven for a predetermined time under the above-described conditions. These portions 11*a*', 12*a*' are located near a basal end of a fan blade 11' of a plastic fan portion 1' and a lock hole 2*a*' of a metal insert portion 2', respectively.

FIG. 7 shows open cracking observed on an up-stream side of a boss 12' and near the basal end of the fan blade 11' of the plastic fan portion 1' after the plastic fan F' was driven for a period about twice as much as the time of occurrence of the above-described whitening under the same conditions. An open crack formed in the fan boss 12' is indicated by symbol 12*b*'.

FIGS. 8 and 9 depicts a phenomenon observed after the plastic fan F' was driven for a period at least three times the time of occurrence of the above-described whitening under the same conditions. Of these drawings, FIG. 8 illustrates the manner of tearing-off of two fan blades 11, and FIG. 9 shows the conditions of the fan boss 12' and the metal insert portion 2' after the blades had been torn off.

SUMMARY OF THE INVENTION

The present invention has been completed to eliminate or at least lessen the above-described problems which are observed on the plastic fan F' according to the conventional art.

With the above-described plastic fan F', it has been found that when the lock holes, which are formed in the outer peripheral portion of the metal insert to ensure a secure interconnection between the insert and the synthetic resin, have small concave/convex deformed portions about their peripheral edges, that these small deformations actually trigger deterioration in the structure and performance of the fans.

The present invention has been completed on the basis of the above-described finding.

In essence, the present invention provides a plastic fan composed of a plastic fan portion, which is formed of fan blades and a fan boss, and a metal insert portion integrally embedded in the plastic fan portion, formed of a ring-shaped flat base portion and a bent portion extending upright from an outer peripheral edge of the base portion and having a substantially ring-shaped configuration in plan and a flattened U-shaped configuration in cross-section, characterized in that:

(i) the metal insert portion defines lock holes arranged at predetermined intervals in an outer peripheral portion of the metal insert portion and extending through the metal insert portion from an outer side thereof to an inner side thereof; and (ii) an inner peripheral edge portion of each of the lock holes is formed of a smooth flat surface on at least one of the outer side and the inner side of the metal-made insert portion.

The present invention has eliminated or at least lessened the problems that in a plastic fan composed of a plastic fan portion and a metal insert portion integrally embedded in the plastic fan portion, the plastic fan portion is lowered in durability and safety due to the above-described construction of the metal insert portion.

In particular, the present invention has provided a countermeasure for the finding that the small concave/convex deformed portions on the peripheral edge portion of each lock hole in the metal insert portion integrally embedded in the fan boss of the plastic fan portion give serious adverse effects to the durability and safety of the plastic fan. Specifically, the present invention has eliminated such adverse effects to the durability and safety of the plastic fan by forming into a flat surface the peripheral edge portion of each lock hole in the metal insert portion.

The present invention therefore provides a reliable plastic fan having excellent durability and safety.

DETAILED DESCRIPTION OF THE INVENTION AND PREFERRED EMBODIMENT

Figure 1:
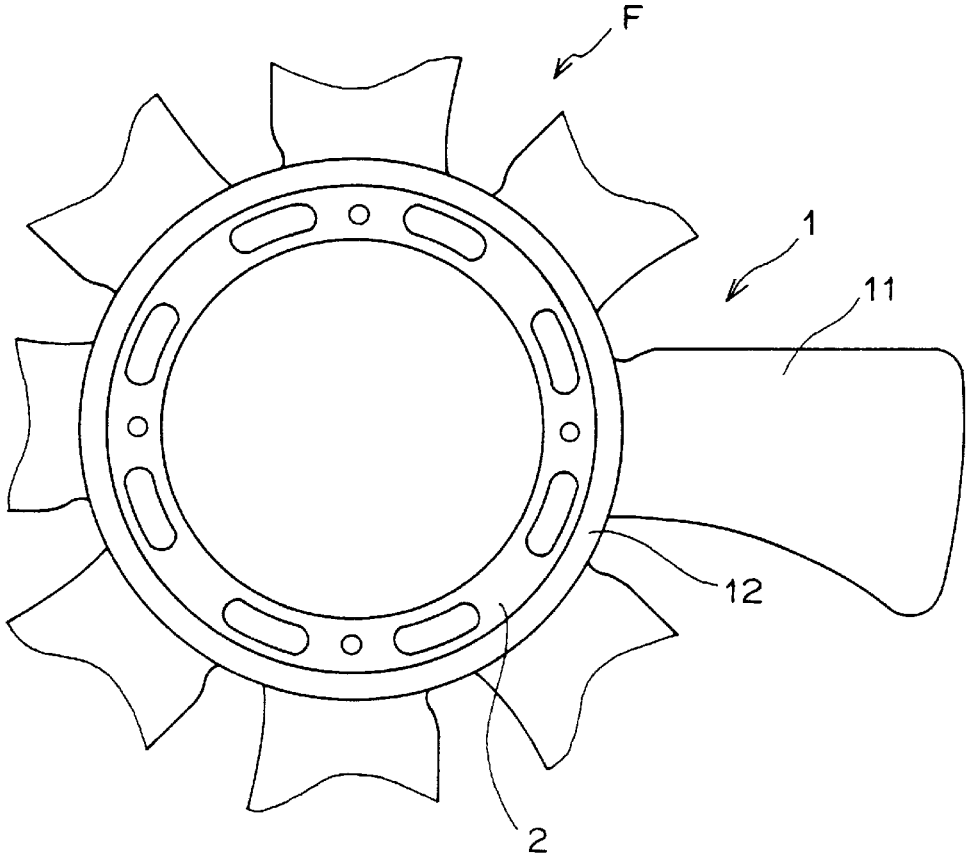
FIG. 1 is a fragmentary plan view of a plastic fan according to an embodiment of the present invention.

The technical features of the present invention and the embodiment of the present invention will hereinafter be described in detail with reference to the drawings.

Needless to say, it is to be noted that the present invention shall not be limited to or by the embodiment illustrated in the drawings.

Figure 2:
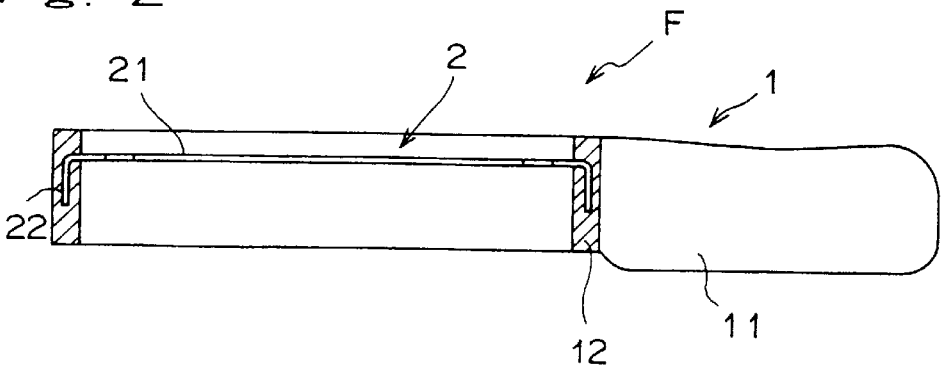
FIG. 2 is a partially cross-sectional view of the plastic fan shown in FIG. 1, taken along a central axis of the plastic fan.

FIGS. 1 and 2 illustrate the overall construction of the plastic fan F according to the embodiment of the present invention.

As is shown in the drawings, the plastic fan F according to this embodiment is composed of:

(i) a plastic fan portion 1 formed of plastic fan blades 11 and a plastic fan boss 12; and (ii) a metal insert portion 2 integrally embedded in the fan boss 12 of the plastic-made fan portion 1 and having a substantially ring-shaped configuration in plan and a flattened U-shaped configuration in cross-section.

As is illustrated in FIG. 1, the plastic fan portion 1 of the plastic fan F according to this embodiment is provided with eight fan blades 11. On the other hand, the metal-made insert portion 2 is formed of a flat base portion 21 and a bent portion 22 as a side portion.

Figure 3:
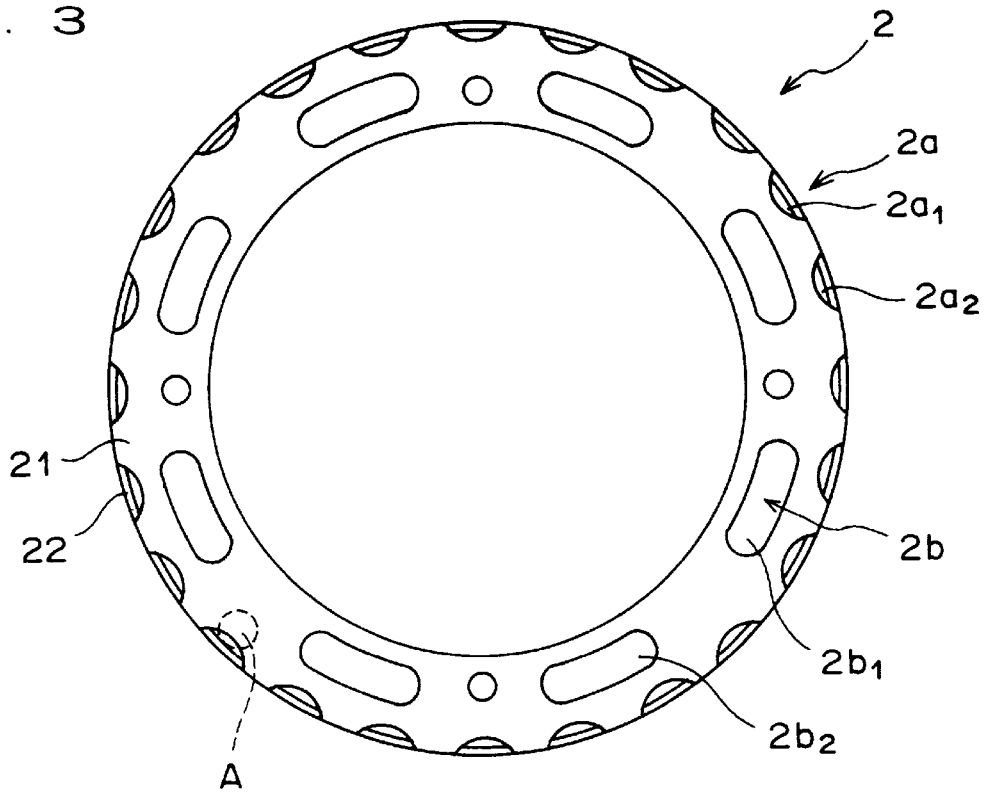
FIG. 3 is a plan view of a metal insert portion of the plastic fan.
Figure 4A:
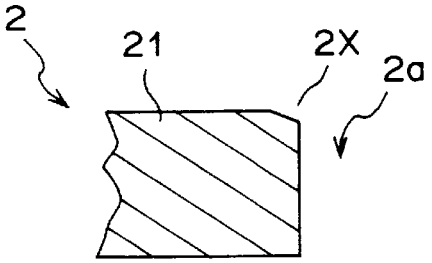
FIG. 4A is an enlarged cross-sectional view of a portion A (encircled by a broken line) in FIG. 3.
Figure 4B:
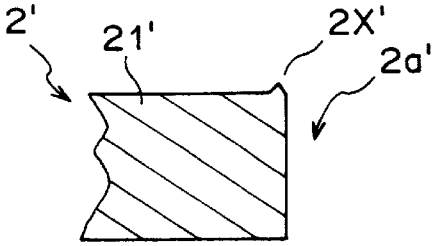
Fig. 4B PRIOR ART
FIG. 4B is an enlarged cross-sectional view of a portion of a conventional plastic fan, said portion corresponding to the portion A (see FIG. 3) of the plastic fan according to the embodiment of this invention.

FIGS. 3, 4A and 4B illustrate a primary characteristic feature of the plastic fan F according to this embodiment.

The cross-sectional view of FIG. 4A shows the portion A (which is encircled by the broken line in FIG. 3) of the flat base portion 21 of the metal insert portion 2 as viewed in a direction from a lock hole 2*a* which will be described subsequently herein.

In other words, FIG. 4A illustrates the construction of a peripheral edge portion of the lock hole 2*a*.

As is shown in FIG. 3, the metal insert portion 2 which is a principal element of the plastic fan F according to this embodiment defines:

(i) a desired number of lock holes 2*a* formed through an outer peripheral portion, namely a portion where the bent portion 22 is arranged as the side portion extending from an outer peripheral edge of the flat base portion 21, and extending over the base portion 21 and the bent portion 22;

(ii) holes 2*b* formed through the flat base portion 21 for adjusting the weight of the plastic fan F and permitting mounting of the plastic fan F on a drive shaft or the like.

Figure 9:
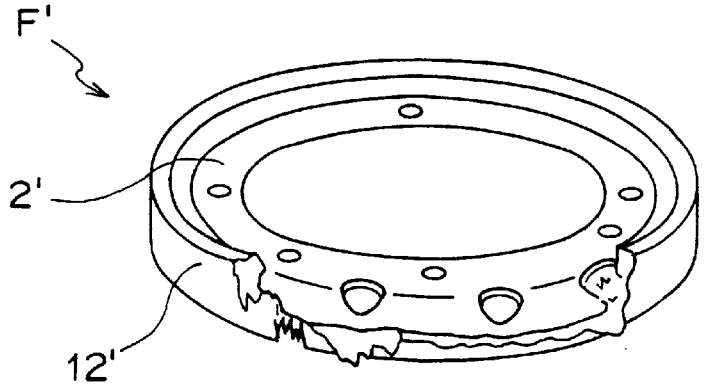
Fig. 9 PRIOR ART
FIG. 9 is a perspective view of the fan boss after the breakage (tearing-off) of the fan blades and the fan boss in FIG. 8.

The manner of arrangement of the lock holes 2*a* described above under (i), that is, the arrangement of the lock holes 2*a* in the manner that they extend over the base portion 21 and the bent portion 22 can be readily understood from FIG. 9 which relates to the conventional art.

As is depicted in FIG. 3, the lock holes 2*a* are arranged as many as 24 in total at desired intervals through the outer peripheral portion of the metal-made insert portion 2.

In the present invention, the lock holes 2*a* can obviously be arranged, for example, only in the bent portion 22 instead of the above-described manner of arrangement, that is, arranging the lock holes 2*a* so that they extend from the outer peripheral edge portion of the base portion 21 to the bent portion 22 as the side portion as described above.

FIG. 4A shows the microstructure of the peripheral edge portion of the lock hole 2*a* formed through the metal-made insert portion 2 of the plastic fan F according to this embodiment.

In this embodiment, the peripheral edge portion of each of the lock holes 2*a* ($2a_1$–$2a_n$; n being a desired integer) formed through the metal-made insert portion 2 is formed on an upper side thereof as viewed in FIG. 3, namely, on an outer side thereof into a smooth flat surface 2*x* as shown in FIG. 4A. More preferably, the peripheral edge portion may also be formed into a similar smooth flat surface on an inner side of the metal-made insert portion 2.

FIG. 4B illustrates the microstructure of the peripheral edge portion of the lock hole 2*a*' formed through the metal insert portion 2' of the plastic fan F' according to the conventional art. FIG. 4B therefore corresponds to FIG. 4A which relates to the present invention.

The lock hole 2*a*' in the conventional art usually has a small concave/convex, deformed portion 2*x*' formed upon boring the lock hole as shown in FIG. 4B.

Figure 5A:
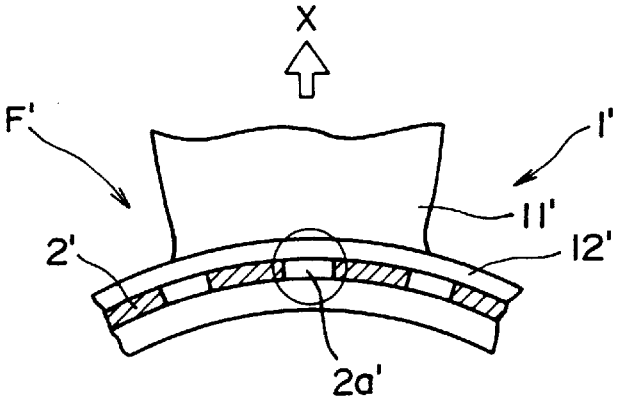
Fig. 5A PRIOR ART
FIGS. 5A and 5B schematically illustrate action of centrifugal stress produced by rotation of a fan blade in the conventional plastic fan.
Figure 5B:
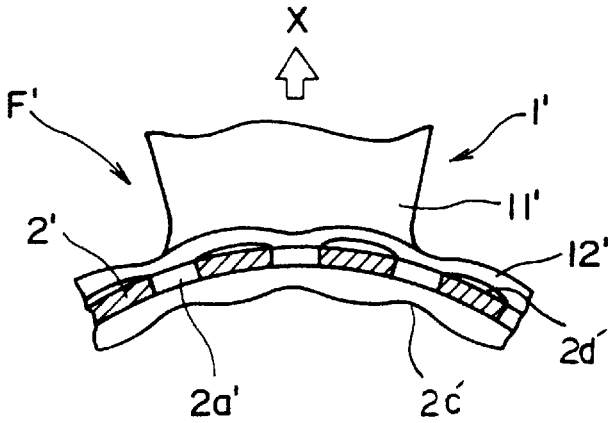
Fig. 5B PRIOR ART
Figure 6:
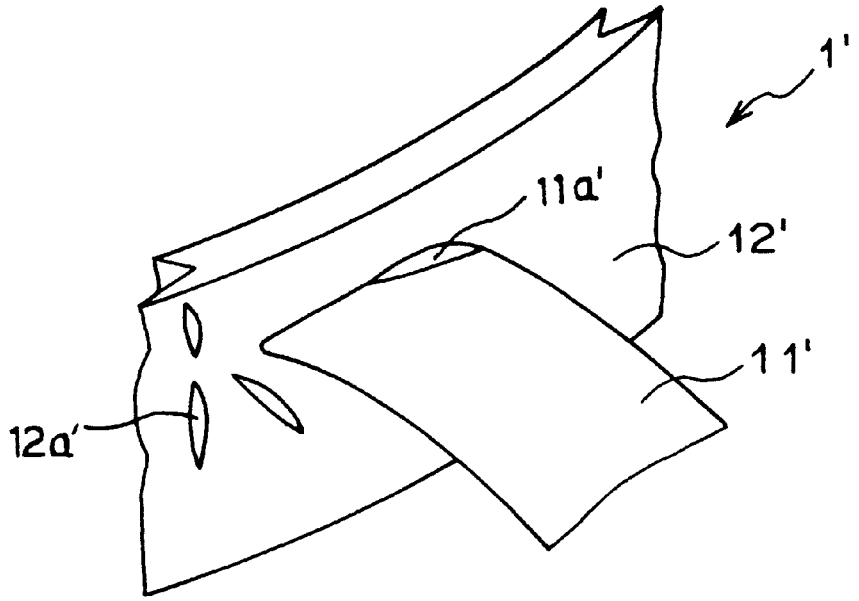
Fig. 6 PRIOR ART
FIG. 6 schematically illustrates whitening of a fan boss and a fan blade in the conventional plastic fan.
Figure 7:
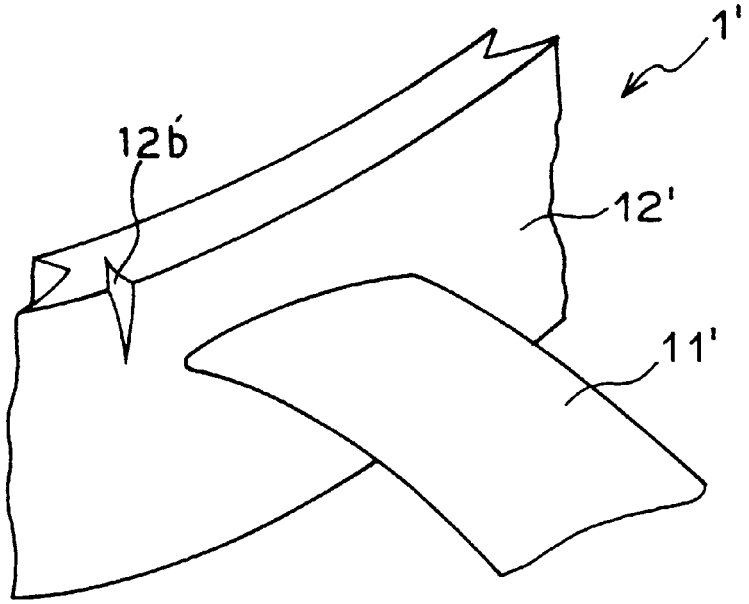
Fig. 7 PRIOR ART
FIG. 7 schematically illustrates open cracking of the fan boss and the fan blade in the conventional plastic fan.
Figure 8:
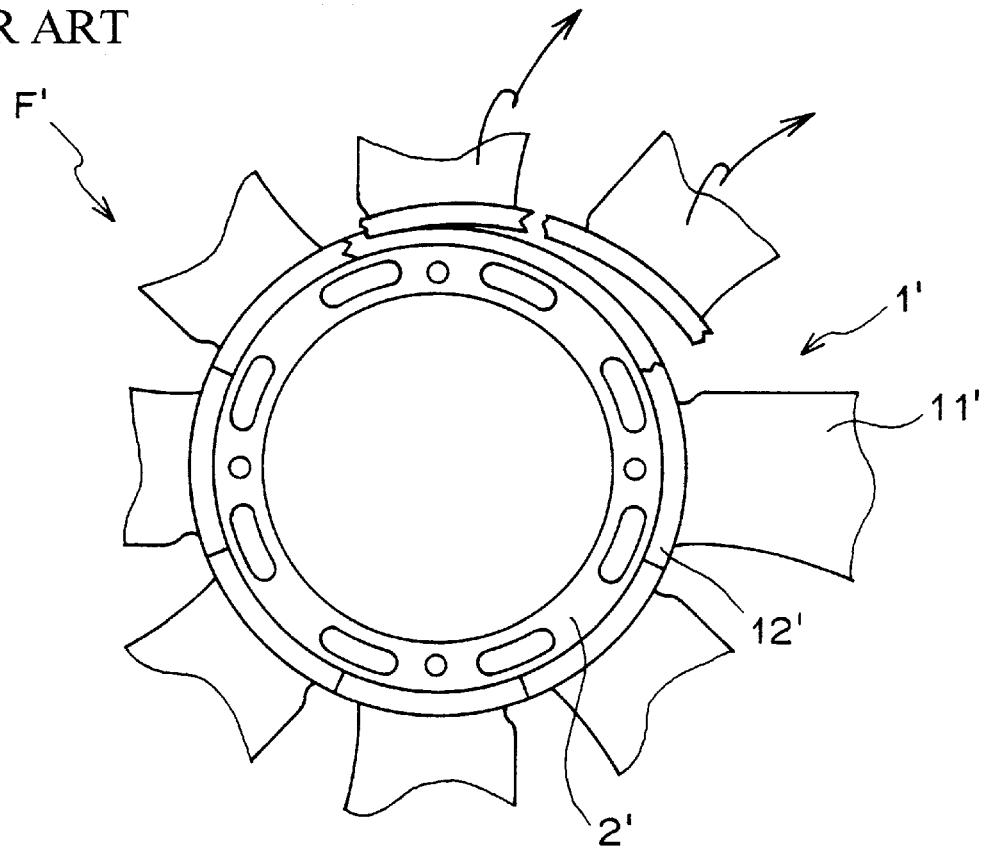
Fig. 8 PRIOR ART
FIG. 8 schematically illustrates breakage (tearing-off) of fan blades and the fan boss in the conventional plastic fan.

The deformed portion 2*x*' is subjected to concentration of large centrifugal stress under high-speed rotation of the plastic fan, and hence acts as a growth point for breaking such as a growth point of a crack or a growth point of whitening. The drawbacks associated with the inclusion of the deformed portion 2*x*' have already been described above with reference to FIGS. 5A thorough 9.

According to the present invention, the peripheral portion of each lock hole 2*a* is formed on at least one of the outer and inner sides of the metal insert portion 2 into the smooth flat portion 2*x* as shown in FIG. 4A so that concentration of stress around the peripheral edge portion of the lock hole 2*a* can be avoided.

In this invention, any desired method can be adopted for the formation of the smooth flat portion 2*x* at the peripheral edge portion of each lock hole 2*a* so that concentration of stress around the peripheral edge portion can be avoided.

For example, the peripheral edge portion of each lock hole 2*a* can be flattened or chamfered.

For flattening, pressing is efficient and productive.

To improve especially the durability of the plastic fan 1 in the present invention, it is indispensable to smoothen (flatten) the peripheral edge portion of each lock hole 2*a* on at least one of the outer and inner sides of the metal insert portion 2. In addition, it is also an important factor how many lock holes 2*a* be arranged. It is therefore desired to improve the durability of the plastic fan portion 1 by taking these requirements into consideration. Test:

A durability test was conducted using a plastic fan according to the present invention and that of the conventional art. Those plastic fans were made of polypropylene as a plastic material, were 430 mm in diameter, and were provided with eight blades and 24 lock holes.

The durability test was conducted under accelerated test conditions of 100° C. in surrounding air temperature and 4,000 rpm in rotation speed. Each plastic fan was operated until breakage.

In the following description, the term "conventional product" means the plastic fan with a metal insert portion in which the peripheral edge portion of each of the 24 lock holes had been subjected to flattening by pressing on neither the inner side nor the outer side of the metal-made insert portion. On the other hand, the term "invention product" means the plastic fan with a metal insert portion in which the peripheral edge portion of each of the 24 lock holes had been subjected to flattening by pressing on the outer side of the metal-made insert portion as described above with reference to FIG. 4A.

The results of the test will be summarized hereinafter. With respect to each problem, the test results will be indicated as a ratio of a time required until the problem was first observed in the invention product to a corresponding time required in the conventional product.

(i) The time until the first occurrence of whitening in the fan boss portion at a location near a basal portion of one of the blades or one of the lock holes of the metal insert portion was about 1.2 times as much as that required in the conventional product.

(ii) The time until the first occurrence of open cracking in the fan boss portion on an upstream side of a location near a basal portion of one of the blades or one of the lock holes of the metal insert portion was about 1.3 times as much as that required in the conventional product.

(iii) The time until the first occurrence of tearing-off of one of the blades together with a portion of the fan boss was about 1.4 times as much as that required in the conventional product.

As is clearly envisaged from the above-described test results, the plastic fan according to the present invention has 1.2 to 1.4 times of superiority over the conventional product.

What is claimed is:

1. In a plastic fan composed of a plastic-made fan portion, which is formed of fan blades and a fan boss, and a metal insert portion integrally embedded in said plastic fan portion, formed of a ring-shaped flat base portion and a bent portion extending upright from an outer peripheral edge of said base portion and having a substantially ring-shaped configuration in plan and a flattened U-shaped configuration in cross-section, the improvement wherein:

said metal insert portion defines lock holes arranged at predetermined intervals in an outer peripheral portion of said metal insert portion and extending through said metal insert portion from an outer side thereof to an inner side thereof;

an inner peripheral edge portion of each of said lock holes is formed of a smooth flat surface on at least one of said outer side and said inner side of said metal insert portion; and each lock hole is formed extending over said base portion and said bent portion.

2. A plastic fan according to claim 1, wherein said smooth flat surface has been formed by chamfering.

3. A plastic fan according to claim 1, wherein said smooth flat surface has been formed by pressing.

* * * * *